United States Patent [19]

Halone et al.

[11] Patent Number: 4,501,379

[45] Date of Patent: Feb. 26, 1985

[54] NEWSPAPER DISPENSING APPARATUS

[76] Inventors: William Halone, 25545 Rice Rd.; James R. Davis, 25575 Rice Rd.,, both of Sweethome, Oreg. 97386

[21] Appl. No.: 505,748

[22] Filed: Jun. 20, 1983

[51] Int. Cl.[3] ..... B65H 3/26; G07F 11/14

[52] U.S. Cl. ..... 221/221; 221/229; 221/232; 221/240; 221/241

[58] Field of Search ..... 221/240, 241, 213, 220, 221/227, 228, 229, 246, 248, 249, 155, 36, 37, 232, 221

[56] References Cited

U.S. PATENT DOCUMENTS

| | | | |
|---|---|---|---|
| 842,002 | 1/1907 | Niell | 221/229 |
| 1,047,549 | 12/1912 | Moffet | 221/36 |
| 1,506,813 | 9/1924 | Camelo et al. | 221/240 X |
| 2,006,100 | 6/1935 | Hight et al. | 221/240 X |
| 2,832,506 | 4/1958 | Hatcher | 221/248 X |
| 3,136,451 | 6/1964 | Deane | 221/240 |
| 3,318,478 | 5/1967 | Hart | 221/227 |

*Primary Examiner*—F. J. Bartuska

*Attorney, Agent, or Firm*—Phillips, Moore, Lempio & Finley

[57] ABSTRACT

Dispensing apparatus for individually dispensing folded newspapers, magazines, or like articles from a stack of articles, comprises a reciprocal dispensing assembly having movable fingers mounted thereon for engaging within a fold of the article to pull the article to a dispensing position from its stacked or stored position. The fingers are laterally spaced and adapted to be extended and inserted into respective lateral ends of the fold. Alternatively, the fingers can be made responsive to the opening of an acess door. In both embodiments, movement of the fingers between their extended and retracted positions is controlled by a pair of longitudinally spaced stops. An adjustment is provided for accommodating the dispensing of articles having varied thicknesses, while maintaining the fingers in the center of the fold of a particular article.

31 Claims, 16 Drawing Figures

FIGURE 3
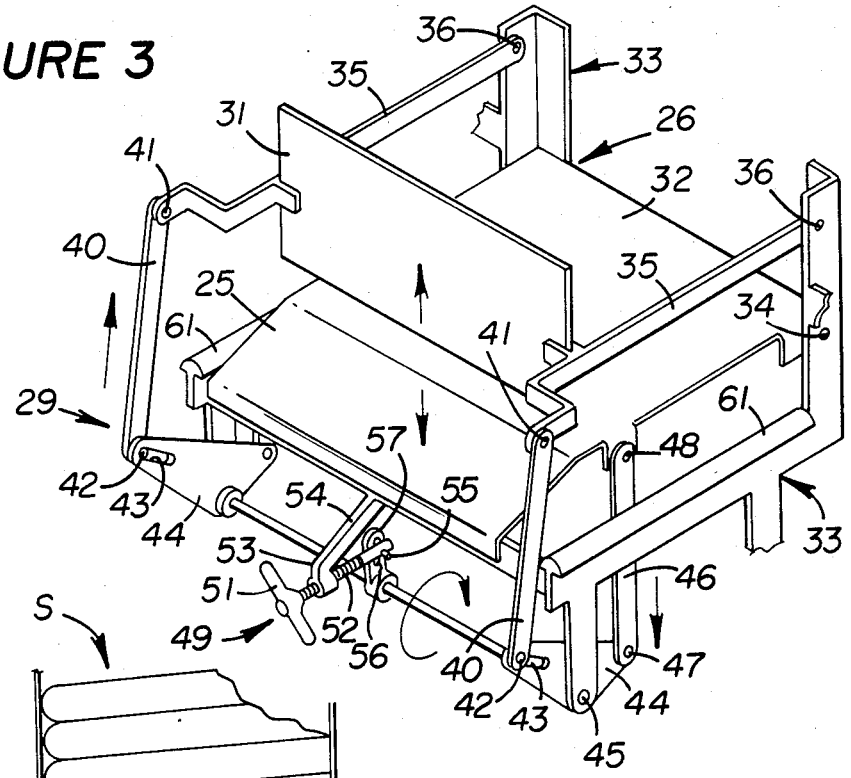
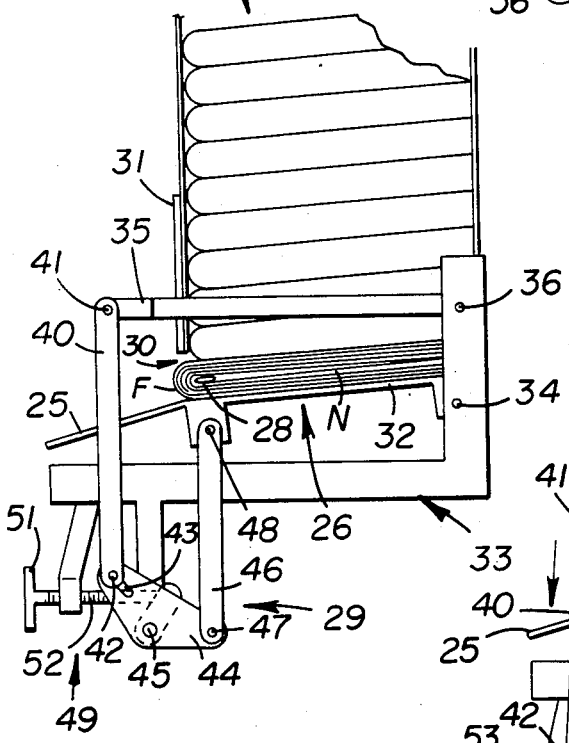
FIGURE 5
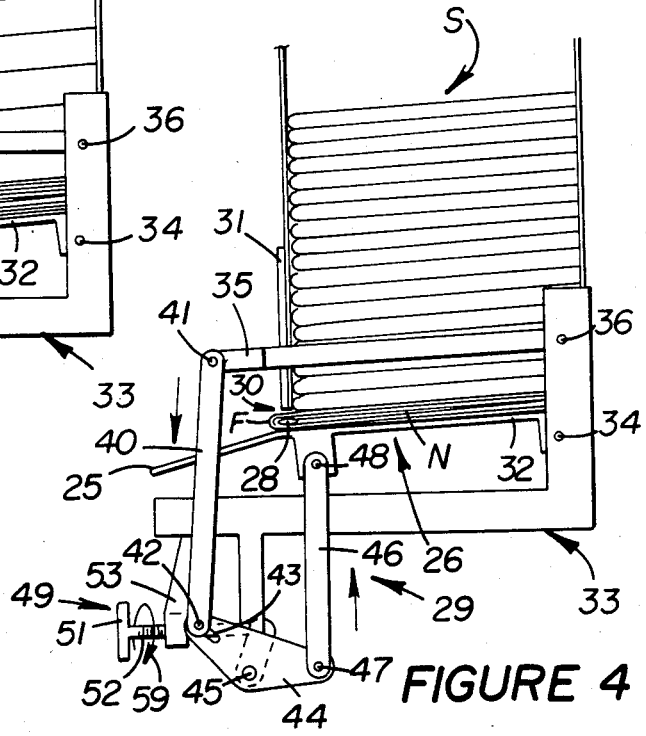
FIGURE 4

FIGURE 6
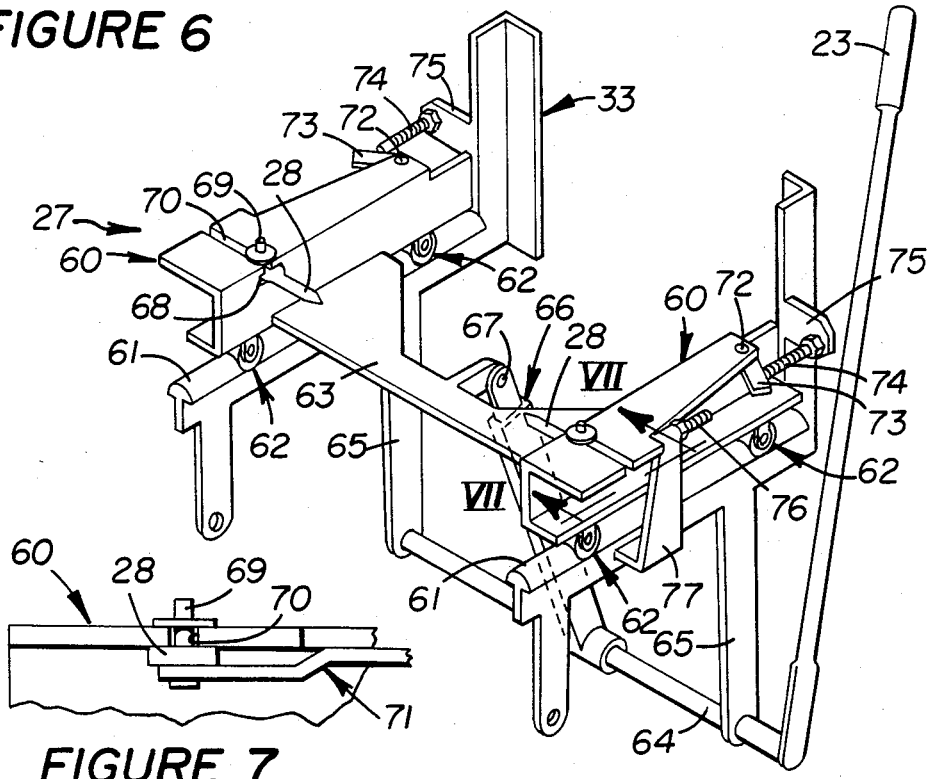
FIGURE 7
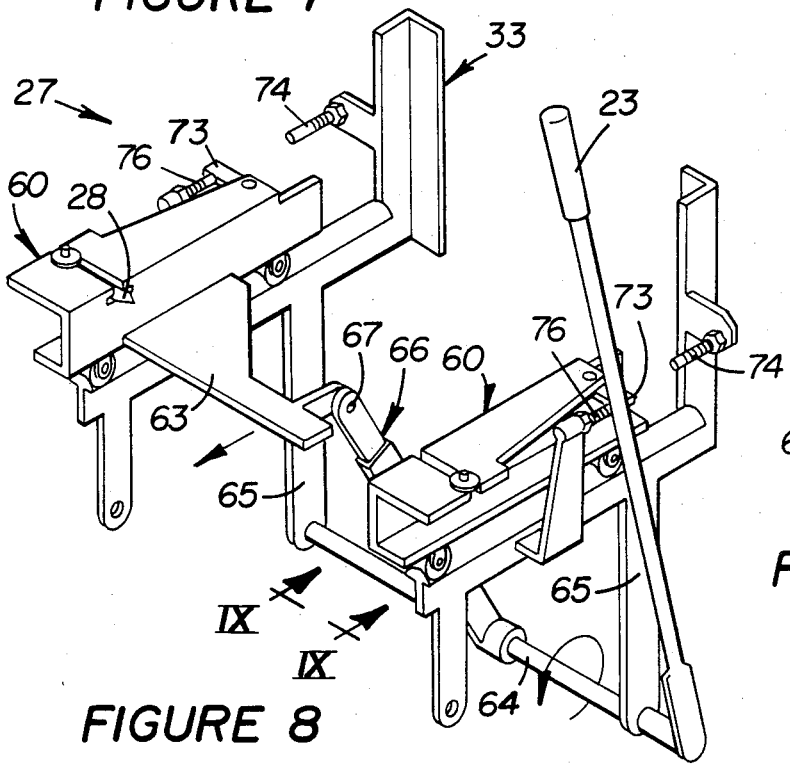
FIGURE 8
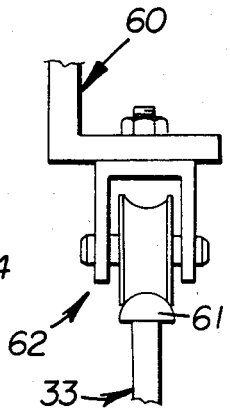
FIGURE 9

NEWSPAPER DISPENSING APPARATUS

DESCRIPTION

1. Technical Field

This invention relates generally to a dispensing apparatus and method and more particularly to an apparatus and method for individually dispensing folded newspapers, magazines, or the like.

2. Background Art

Conventional dispensing apparatus for individually dispensing folded newspapers, magazines, or like articles, normally include a device for engaging and pushing a rearward edge of the folded article or devices for frictionally or piercingly engaging the article for dispensing purposes. Apparatus of this type tend to cause jamming problems and also tend to tear the article. In addition, the dispensing of newspapers gives rise to the further problem of resetting the size of the newspaper dispensing opening to accommodate the relatively thick Sunday edition. Conventional dispensing apparatus of this type are also unduly complex, expensive to manufacture and service, and do not provide the desired service life.

DISCLOSURE OF INVENTION

An object of this invention is to overcome the above, briefly-described shortcomings of the prior art by providing a relatively non-complex and low-cost dispensing apparatus and method for newspapers, magazines, and like articles. The apparatus exhibits a high degree of structural integrity and durability, resulting in a long service life.

The dispensing apparatus comprises first means for retaining a stack of folded articles in a stored position, and second means for individually moving each article from the stack, including movable finger means for engaging within the fold of the article and for pulling the article to a dispensing position from its stored position.

The method aspect of this invention is defined in terms of the steps of retaining the articles in stacked relationship, and applying a moving force within the fold of an article to individually pull each article from the stack of articles. In both the apparatus and method, the article can be pulled either from the bottom or top of the stack.

In another aspect of this invention, means are provided for selectively and expeditiously adjusting a dispensing opening to accommodate articles having varied thicknesses, such as the difference in thicknesses between a daily and Sunday edition of a newspaper. The unique feature of this adjustment means resides in its ability to maintain the above-described finger means in a fixed, centered position relative to the opening, regardless of the varied size of the opening. This arrangement ensures that the finger means will always enter into the center of the fold of the dispensed article when it is pulled to its dispensing position.

BRIEF DESCRIPTION OF THE DRAWINGS

Other objects and advantages of this invention will become apparent from the following description and accompanying drawings wherein:

FIG. 3 is a view similar to FIG. 2, but with a movable dispensing assembly removed from the dispensing apparatus to more clearly illustrate a dispensing opening adjustment assembly of the apparatus;

FIGS. 4 and 5 are side elevational views of the dispensing opening adjustment assembly, showing the adjustment of a dispensing opening for a relatively thin daily newspaper (FIG. 4) and a relatively thicker Sunday edition of the newspaper (FIG. 5);

FIG. 6 is a view similar to FIG. 2, but with the dispensing opening adjustment assembly essentially removed to more clearly illustrate the movable dispensing assembly and its attendant components and actuators;

FIG. 7 is an enlarged segmental view, taken generally in the direction of arrows VII—VII in FIG. 6, illustrating the mounting of a reciprocal finger assembly therein;

FIG. 8 is a view similar to FIG. 6, but illustrates actuation of the movable dispensing assembly from its FIG. 6 position, wherein a pair of the finger assemblies are extended to its FIG. 8 position, wherein the finger assemblies are retracted subsequent to the dispensing of a newspaper;

FIG. 9 is an enlarged segmental view, taken generally in the directions of arrows IX—IX in FIG. 8, illustrating a mounting arrangement for the movable dispensing assembly on a stationary frame of the dispensing apparatus;

BEST MODE OF CARRYING OUT THE INVENTION

GENERAL DESCRIPTION

Figure 1:
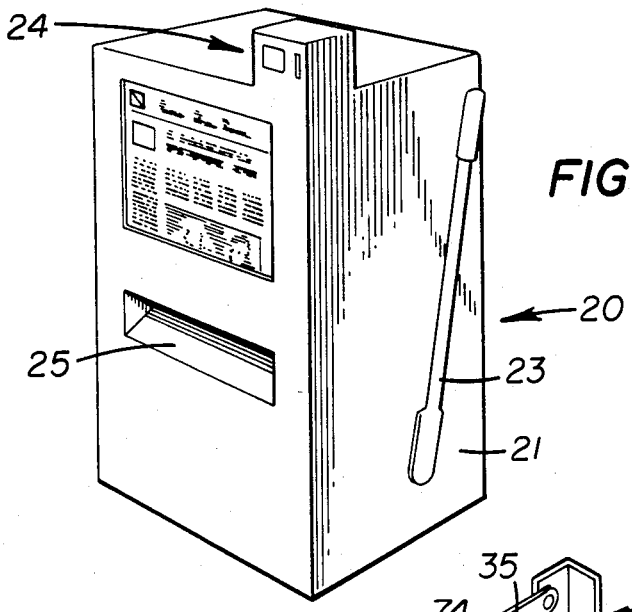
FIG. 1 is a front perspective view of a vending machine having a newspaper dispensing apparatus of the present invention mounted therein.
Figure 2:
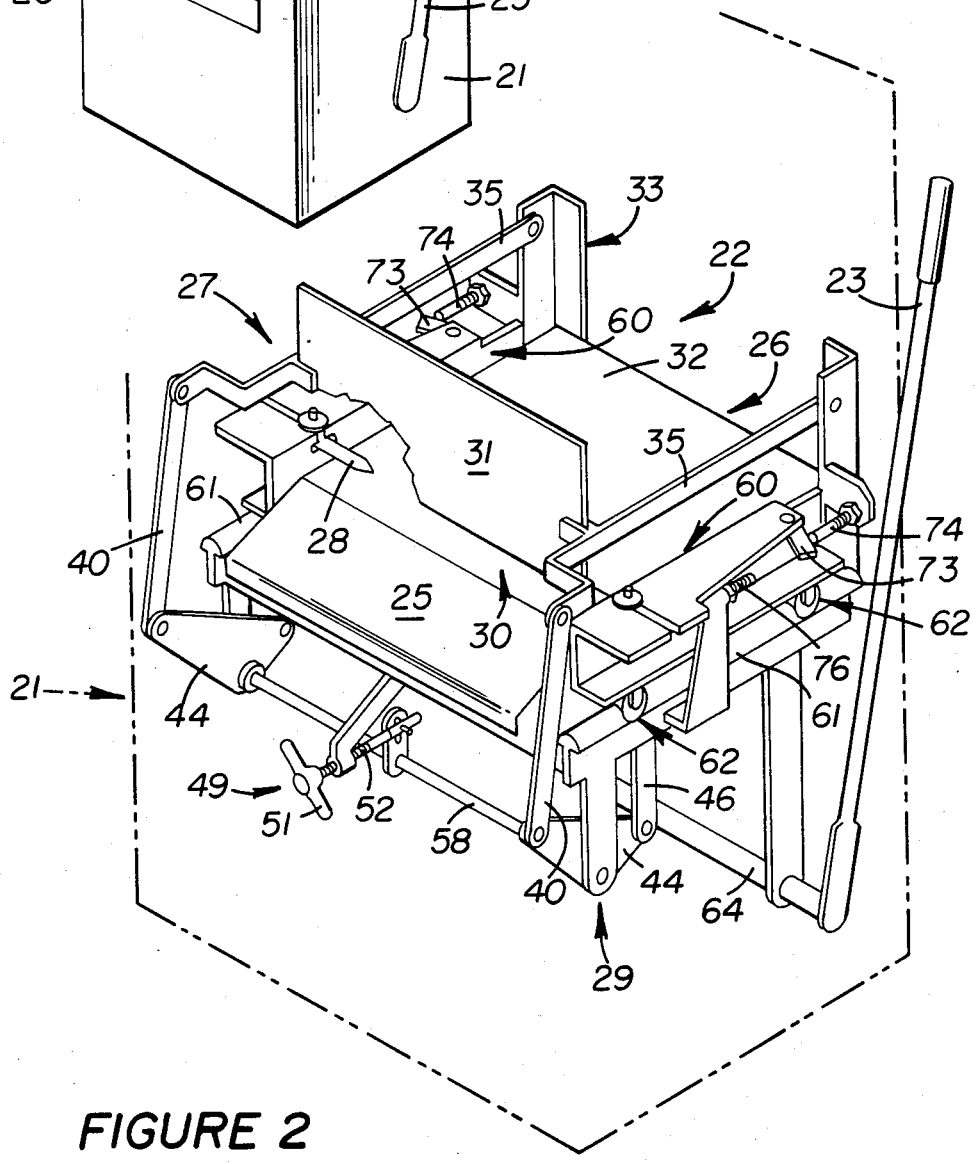
FIG. 2 is a front isometric view of the dispensing apparatus with parts thereof removed or sectioned for clarification purposes.

FIG. 1 illustrates a vending machine 20 comprising a cabinet 21 containing a dispensing apparatus 22 of the present invention therein, the dispensing apparatus being shown in FIG. 2. The dispensing apparatus includes a handle 23, mounted on the outside of cabinet 21, adapted to be released in a conventional manner upon depositing the proper coinage in a conventional coin box 24. Upon release of the handle, a purchaser need only pull the handle forwardly to remove a single newspaper from a stack of newspapers and deposit the newspaper on an exposed shelf 25. Since this invention is primarily directed to dispensing apparatus 22, the particular configuration of cabinet 21 and the specific means (not shown) for releasing handle 23 upon depositing the proper coinage in box 24 may be of any standard types and do not require further explanation for a full understanding of this invention.

Referring to FIGS. 2 and 4, a stack S of newspapers N are retained in a stored position on a table assembly 26. Each newspaper is folded-over onto itself to define a forwardly disposed fold F. When handle 23 is pulled forwardly in FIG. 2, the lowermost newspaper N in FIG. 4 will be individually moved from the stack. In particular, and referring to FIGS. 10–12, a movable dispensing assembly 27 is reciprocally mounted on table assembly 26 for moving the newspaper from its stored position illustrated in FIG. 10 to its dispensing position illustrated in FIG. 12. Forward movement of the dispensing assembly functions to apply a moving force within fold F of the newspaper to pull it to its dispensing position in contrast to conventional newspaper dispensing apparatus which rely on a pushing or mechanical gripping of a newspaper for dispensing purposes.

The moving or pulling force applied within the fold of the newspaper is effected by a pair of finger assemblies, including movable fingers 28, mounted on dispensing assembly 27. As will be described in detail hereinafter, the fingers are laterally spaced and in alignment to be inserted into lateral ends of fold F of the newspaper for pulling the paper to its dispensing position, illustrated in FIG. 12. At the FIG. 12 dispensing position, the fingers automatically retract, whereafter handle 23 is recocked to its FIG. 2 position. When the handle is recocked, the fingers responsively extend to their FIG. 10 operative positions whereby they are again inserted into the lateral ends of the fold of the next following newspaper. FIG. 13 illustrates a modified finger assembly wherein fingers 28' are adapted to be alternately retracted and extended in generally the same manner.

As will be described more fully hereinafter in connection with the modified vending machine 20' illustrated in FIGS. 14–18, the dispensing apparatus can be essentially inverted to dispense individual newspapers from the top of the stack rather than from the bottom thereof and movement of fingers **28*a* is responsive to the opening of a door 78** of the vending machine.

FIGS. 4 and 5 illustrate another feature of this invention; namely, a dispensing opening adjustment assembly 29 for selectively and expeditiously changing the size of a dispensing opening 30. As described in detail hereinafter, a vertically movable gate 31 and a table or platen 32 of table assembly 26 can be moved simultaneously towards or away from each other in a vertical direction to change the size of the dispensing opening. This adjustment feature is particularly useful for the dispensing of newspapers, the thickness of which can vary from relatively thin for a daily newspaper of the type illustrated in FIG. 4 to the relatively thick Sunday edition of the newspaper, illustrated in FIG. 5. The uniqueness of this adjustment feature is illustrated in FIGS. 4 and 5 wherein each dispensing finger 28 will remain at the center of opening 30, even though the width of the opening is varied, to ensure that the fingers will enter the center of the fold of the newspaper for dispensing purposes.

Modified vending machine 20' of FIGS. 14–18 employs a similar adjustment assembly 29', described in detail hereinafter. Although the vending machine embodiments of this invention are particularly useful for the dispensing of newspapers, they are equally useful for the dispensing of other articles, such as magazines, that are folded over onto themselved to define a fold whereat fingers 28, 28', or **28*a* are adapted to enter and pull the article from a stack of articles. It should be further understood that various modifications can be made to the vending machines, as described, without departing from the scope of this invention. For example, vending machine 20** could be suitably modified to individually dispense newspapers N from the top of the stack and/or to remove the newspapers in response to the opening of an access door.

Detailed Description of Vending Machine 20

Dispensing Opening Adjustment Assembly 29

Referring to FIGS. 2–5, table 32 has opposite sides of its rearward end pivotally mounted on a stationary frame 33 of the vending machine by a pair of laterally-aligned pivot pins 34 (one shown). Gate 31 is secured to a pair of laterally spaced links 35, each having its rearward end pivotally mounted on frame **33*a* by a pin 36. Forward ends of the links are each pivotally attached to a second link 40 by a pin 41 with the lower end of the latter link having a pin 42 secured thereto. Pin 42 is disposed in a lost-motion slot 43, formed through a first end of a triangularly shaped bellcrank 44, having its midportion pivotally mounted on frame 33 by a pin 45**.

A second end of the bellcrank is pivotally mounted to a lower end of a third link 46 by a pin 47 with the upper end of the latter link being pivotally connected to table 32 by a pin 48. It can be seen in FIGS. 4 and 5 that clockwise pivoting of bellcrank 44 about pin 45 will function to move gate 31 and table 32 away from each other at substantially equal rates to widen dispensing opening 30. Conversely, counterclockwise pivoting of the bellcrank in these figures will function to move the gate and table towards each other to narrow the opening.

An actuating means 49, readily accessible to a serviceman or vendor, is provided for this purpose. Still referring to FIGS. 3–5, actuating means 49 comprises a T-handle 51 secured to an outer end of a screw shaft 52. The screw shaft is threadably mounted within an internally threaded collar 53 secured to stationary frame 33 by a bracket 54. The inner end of the screw shaft has a cross pin 55 secured thereon and engaged within an elongated lost-motion slot 56.

The slot is formed in a crank arm 57 which is secured on a rock shaft 58 having its opposite ends secured to bellcranks 44. It can thus be seen that rotation of handle 51 and screw shaft 52 in the direction indicated by arrow 59 in FIG. 4 will pivot each bellcrank 44 about the axes of pins 45 to move gate 31 and table 32 toward each other to narrow dispensing opening 30. Conversely, opposite rotation of the handle and screw shaft will pivot the bellcranks to widen the opening, as illustrated in FIG. 5.

Movable Dispensing Assembly 27

Referring to FIGS. 6–9, dispensing assembly 27 includes a pair of brackets 60 each reciprocally mounted on an elongated rail 61 secured to frame 33. In the embodiment illustrated, each rail comprises a half-round rod of semi-circular cross-section secured on the stationary frame of the dispensing apparatus. A pair of standard and longitudinally-spaced roller assemblies 62, more clearly shown in FIG. 9, mount each bracket 60 for rolling movements on a respective rail 61. Brackets 60 are secured together for simultaneous movement by a cross-member 63.

Dispensing handle 23 is connected to cross-member 63 by a suitable linkage means to reciprocate dispensing assembly 27 and dispensing fingers 28 for purposes generally described above and more specifically described hereinafter. The linkage means may comprise a rock shaft 64 secured to handle 23 and rotatably mounted on a pair of laterally spaced brackets 65, secured to frame 33. A standard telescopic link 66 has its lower end suitably secured to rock shaft 64 and its upper end pivotally connected to cross-member 63 by a pin 67. The telescopic link provides a lost-motion function for permitting reciprocation of the dispensing assembly, as illustrated in FIGS. 6 and 8.

The dispensing assembly further comprises means for automatically extending and retracting fingers 28 in response to reciprocation of the dispensing assembly. In particular, each finger is adapted to project through an elongated slot 68 formed through a side wall of a respective bracket 60 and is suitably connected to a pin 69 slidably mounted in a lateral slot 70, formed through a top wall of the bracket. As shown in FIG. 7, a lower end of pin 69 has one arm of a bellcrank 71 pivotally mounted thereon with the bellcrank being pivotally mounted on bracket 60 proper by a pin 72 (FIGS. 6 and 10).

Figure 10:
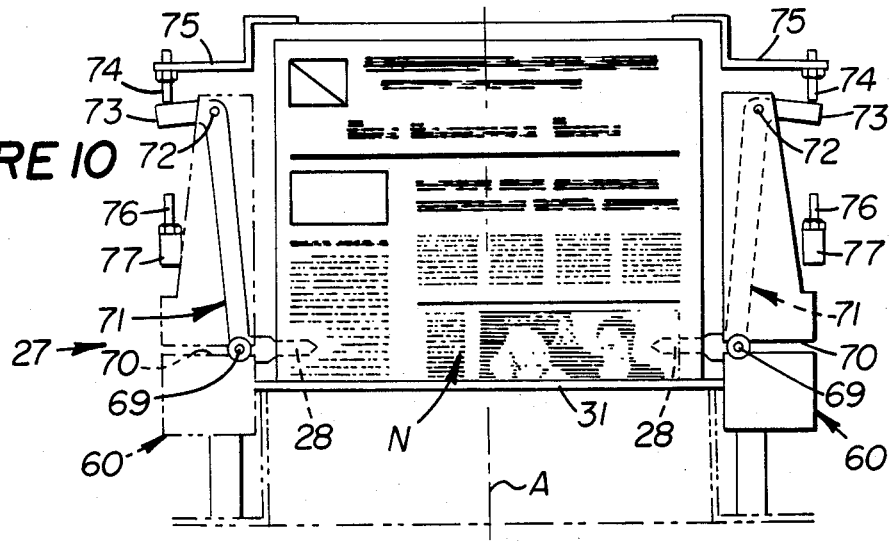
FIGS. 10–12 are top plan views sequentially illustrating reciprocation of the movable dispensing assembly and finger assemblies for purposes of dispensing a newspaper from the dispensing apparatus.
Figure 11:
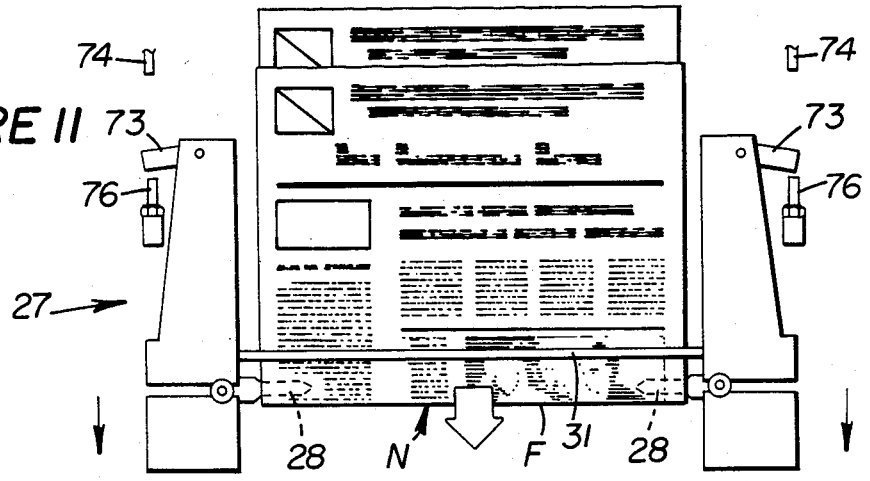
Figure 12:
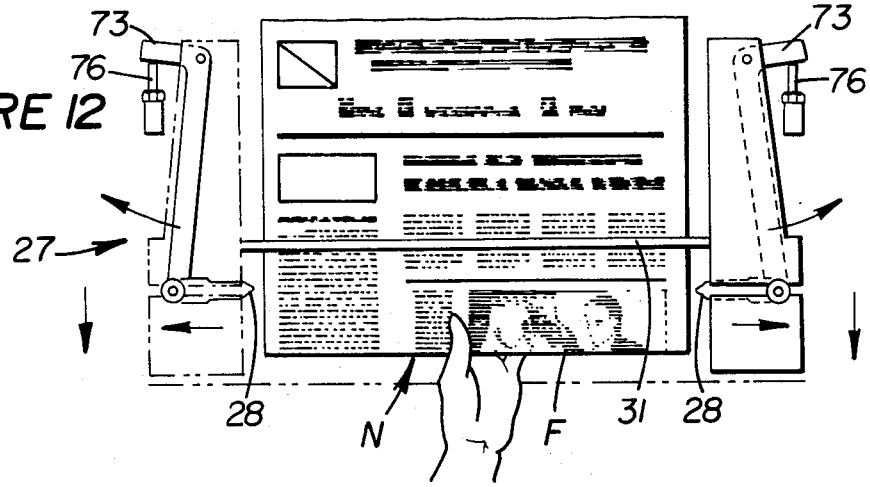
Figure 13:
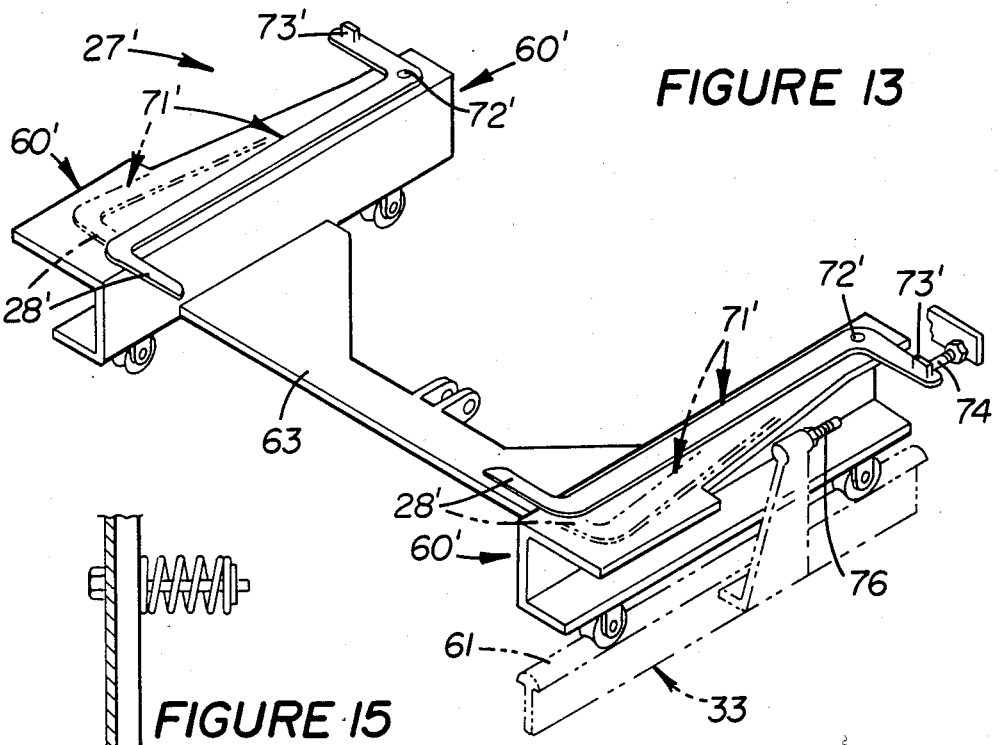
FIG. 13 is an isometric view illustrating a modification of the movable dispensing assembly and finger assemblies.

As more clearly shown in FIGS. 10–12, a second arm 73 of bellcrank 71 extends laterally on an outer side of a respective bracket 60 to provide means for automatically moving finger 28 between its extended position illustrated in FIG. 10 and its retracted position illustrated in FIG. 12. Such means further includes a first stop means or bolt 74 adjustably mounted on a bracket 75 secured rearwardly on frame 33 and a second stop means or bolt 76 adjustably mounted on a bracket 77, also secured on the frame. As sequentially illustrated in FIGS. 10–12, bolts 74 and 76 are spaced longitudinally in the direction of movement of dispensing assembly 27 and in the direction of its longitudinal axis A. Thus, retraction of the assembly to its FIG. 10 position will engage arm 73 with bolt 74 to pivot bellcrank 71 counterclockwise about pin 72 to extend finger 28 to its operative position within the fold of the lowermost newspaper N.

When the correct coinage is deposited in coin box 24 to release handle 23 (FIG. 1) and the handle is pulled forwardly, dispensing assembly 27 will move through its FIG. 11 position to its FIG. 12 dispensing position. Arm 73 will then engage bolt 76 to pivot the bellcrank clockwise about pin 72 to retract finger 28 to its inactive position. As further illustrated in FIG. 12, the newspaper is thus released to permit the purchaser to grasp the newspaper at its folded end on shelf 25 and fully release the newspaper from the stack.

Thereafter, handle 23 can be recocked to its original, FIG. 1 position to ready the dispensing apparatus for a subsequent dispensing operation. When the dispensing assembly returns to its FIG. 10 retracted position, fingers 28 will remain in their retracted FIG. 12 positions until arm 73 engages stop bolt 74 to again reinsert the fingers closely behind the fold of the lowermost and next following newspaper. The handle can be recocked either manually or automatically, such as by suitably interconnecting a tension spring (not shown) between frame 33 and cross-menber 63.

Modified Finger Assembly

FIG. 13 illustrates a dispensing assembly 27′ having modifed finger assemblies adapted to be substituted in lieu of each of the above-described finger assemblies illustrated in FIGS. 2, 6–8, and 10–12. As shown, each slightly modified bracket 60′, adapted to be reciprocally mounted on frame 33 of the vending machine in the manner described above, has a bellcrank 71′ of a respective finger assembly pivotally mounted thereon by a pin 72′. One end of the bellcrank has a finger 28′ secured thereon to extend laterally therefrom for pivotal movement about pin 72′, between its full-line extended position and its phantom-line retracted position. Pivotal movement of the bellcrank and finger is controlled by an upstanding lug 73′, secured on a second arm of the bellcrank and adapted to alternately engage first and second stop means 74, 76, for purposes described above and as generally illustrated in FIGS. 10–12.

Detailed Description of Vending Machine 20A

Figure 15:
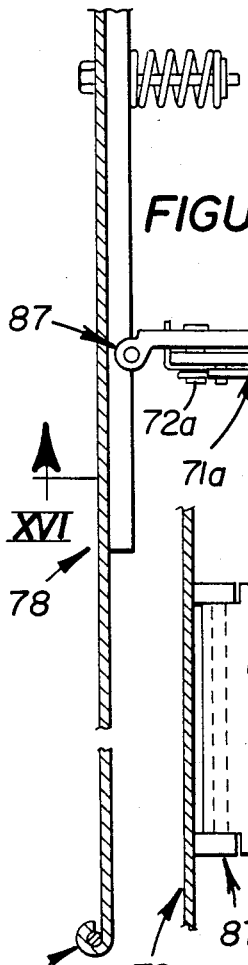
FIG. 15 is an enlarged and sectioned side elevational view, illustrating connection of one of a pair of reciprocal finger assemblies to the door of the vending machine.
Figure 16:
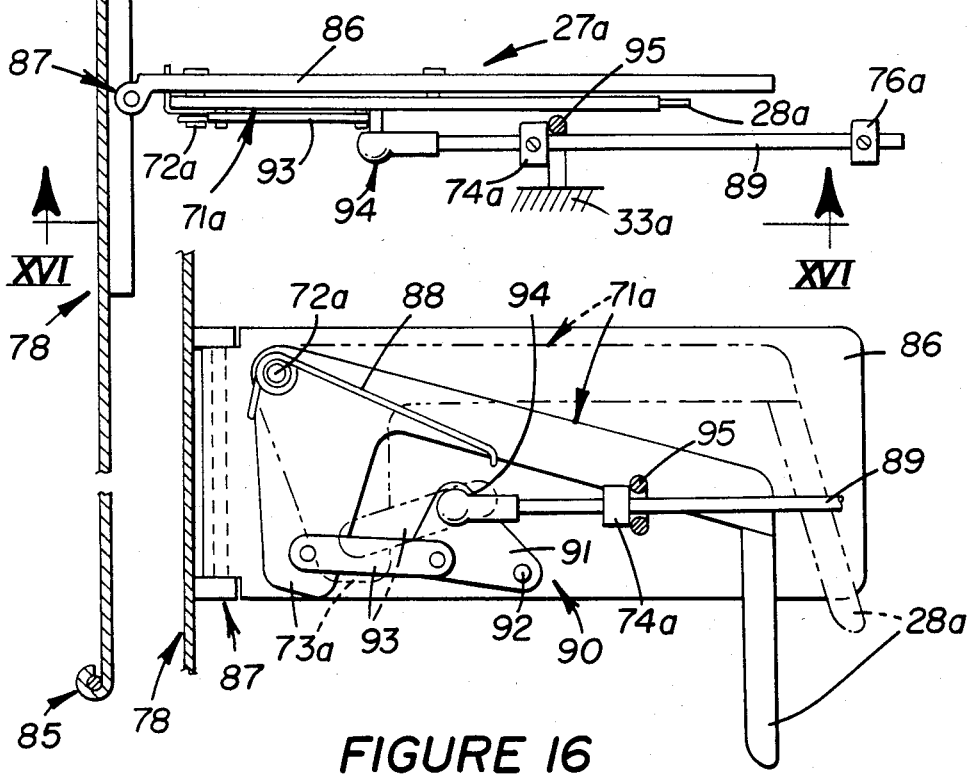
FIG. 16 is a bottom plan view of one finger assembly, taken in the direction of arrows XVI—XVI in FIG. 15, showing a finger thereof in solid and phantom-line retracted and extended positions, respectively.
Figure 14:
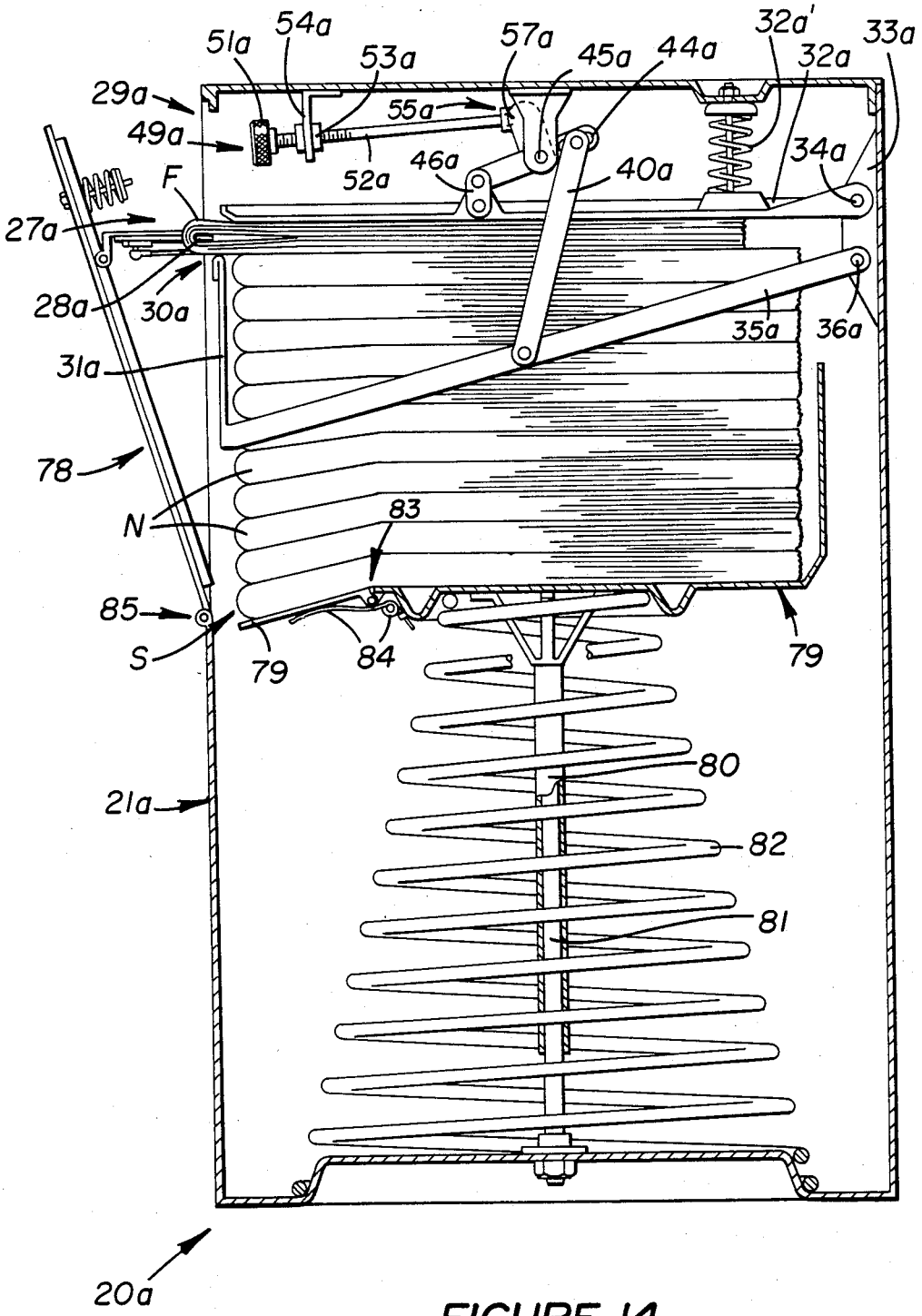
FIG. 14 is a side elevational and partially sectioned view of a modified vending machine wherein newspapers are individually removed and dispensed from the top, rather than from the bottom, of a stack of newspapers in response to the opening of an access door, with certain parts removed for clarification purposes.

FIGS. 14–16 disclose a modified vending machine 20*a* wherein identical numerals depict constructions having corresponding functions, but with numerals depicting modified constructions in these figures each being accompanied by an "a". Vending machine 20*a* essentially differs from vending machine 20 in that newspapers N are individually dispensed from the top, rather than from the bottom, of stack of newspapers S by a dispensing assembly 27*a*. In addition, such dispensing is responsive to the opening of an access door 78 hingedly mounted on a cabinet 21*a* of the vending machine, i.e., dispensing handle 23, reciprocal dispensing assembly 27, and their related components are eliminated.

Dispensing Opening Adjustment Assembly 29

As shown in FIG. 14, a dispensing opening adjustment assembly 29*a* is adapted to selectively and expeditiously change the width of a dispensing opening 30*a* in much the same manner as above-described adjustment assembly 29. A vertically movable gate 31*a* and a flat plate member 32*a*, mounted on stack of newspapers S, are adapted to be moved simultaneously towards or away from each other in a general vertical direction to change the size of the dispensing opening to accommodate newspapers having varied thicknesses. Adjustment assembly 29*a* also ensures that dispensing fingers 28*a* (one shown) will remain at the center of opening 30*a* for each adjusted width of the opening to thus ensure that the fingers will enter the center of fold F of the newspaper for dispensing purposes.

Member 32*a* has each lateral rearward end pivotally mounted on a stationary bracket or frame 33*a* of vending machine 20*a* by a pivot pin 34*a*. Gate 31*a* is secured between the forward ends of a pair of laterally-spaced links 35*a* (one shown), each having its rearward end pivotally mounted on frame 33*a* by a pin 36*a*. A second link 40*a* is pivotally interconnected between each link 35*a* and a first end of a bellcrank 44*a*. A lost-motion connection, similar to that shown between pin 42 and slot 43 in FIG. 5, could be utilized to connect link 40*a* to the bellcrank, if needed, to compensate for the arcuate movements of the links.

A midportion of bellcrank 44*a* is pivotally mounted on a bracket secured to frame 33*a* by a pin 45*a* and a second end of the bellcrank is pivotally mounted to a third link 46*a* (also by a lost motion connection, if needed), pivotally connected to member 32*a*. Thus, it can be seen that clockwise pivoting of bellcrank 44*a* in FIG. 14, about pin 45*a*, will function to move gate 31*a* and plate 32*a* away from each other at substantially equal rates to widen dispensing opening 30*a* a predetermined amount. Conversely, counterclockise pivoting of the bellcrank will function to move the gate and member toward each other to narrow the opening.

An actuating means 49*a*, similar to actuating means 49 of FIG. 3, is adapted to effect such adjustment of opening 30*a*. In particular, the actuating means comprises a centrally-disposed knob or handle 51*a* secured to an outer end of a screw shaft 52*a*. The screw shaft is threadably mounted within an internally threaded collar 53*a*, secured to a bracket 54*a* of frame 33*a*. A universal ball and socket connection 55*a* connects the inner end of screw shaft 52*a* to a crank arm 57*a*, secured on a rock shaft (not shown) having its opposite ends secured to each bellcrank 44*a* in alignment with pivot pins 45*a*. It can thus be seen that rotation of handle 51*a* in either direction will pivot the bellcranks for the above-described adjustment purposes.

As further shown in FIG. 14, stack of newspapers S is supported on a reciprocal table 79, secured on a centrally-disposed telescopic tube reciprocally mounted on a stationary center post 81. A conically-shaped coil spring 82 is mounted within cabinet 21*a* of the vending machine to engage beneath table 79 to continuously urge the newspapers upwardly against member 32*a*. A plurality of laterally spaced compression coil springs 32*a*' (one shown) are suitably mounted between an upper stationary wall of cabinet 21*a* and member 32*a* to bias the member against the topmost newspaper and to take-up any slack in the various linkages connected thereto. A forward portion 79' of table 79 is preferably pivotally mounted thereon at a hinge connection 83 and urged upwardly against the underside of the stack of newspapers by a torsion spring 84 to yield and compensate for the thicknesses of folds F of the newspapers.

Door Actuated Dispensing Assembly 27

Referring to FIGS. 15 and 16, dispensing assembly 27*a* functions to remove and dispense the topmost newspaper N from stack S in response to the opening of access door 78. The door is pivotally mounted on a front panel of cabinet 21*a* by a hinge connection 85 whereby counterclockwise pivoting of the door in FIGS. 14 and 15 will move the topmost paper to the dispensing position illustrated in FIG. 14, i.e., the partially removed newspaper can be grasped and removed. Dispensing assembly 27*a* includes a plate 86 pivotally mounted on an inner side of the door by a hinge connection 87.

Referring to the underside view of one of the two finger assemblies in FIG. 16, finger 28*a* is secured to a first arm of a bellcrank 71*a* with the bellcrank being pivotally mounted on an underside of plate 86 by a pin or bolt 72*a*. A torsion spring 88 is mounted on pin 72*a* and has one end anchored to plate 86 and a second extended end engaged with the bellcrank to urge finger 28*a* to its retracted position, shown in phantom lines in FIG. 16.

A second arm 73*a* of the bellcrank is connected to an actuating rod 89 by an overcenter linkage 90. The overcenter linkage comprises a first triangularly shaped lever 91, pivotally mounted on an underside of plate 86 by a pin 92, and a link 93 pivotally interconnected between the lever and arm 73*a* of the bellcrank. A ball and socket connection or ball joint 94 pivotally connects rod 89 to lever 91 to compensate for slight displacement of the rod upon opening of door 78.

As shown in FIG. 15, the rod is slidably mounted in a stationary U-shaped bracket 95, secured to frame 33*a* of the vending machine, to alternately engage a first or second stop means 74*a* or 76*a*, respectively, adjustably secured on the rod. The stop means are in the form of collars, each releasably secured for sliding movements on the rod by a set screw, whereby the collars can be adjusted longitudinally on the rod. As shown, closing of the door will engage collar 74*a* with bracket 95 to actuate overcenter linkage 90 to extend finger 28*a* to its solid-line extended operative position within the fold of the uppermost newspaper N. When the door is initially opened to dispense a newspaper, linkage 90 will remain "cocked" to retain the finger fully extended. Opening of the door to its fullest extent (e.g., approximately seven inches at its widest opening relative to cabinet 21*a*) will engage collar 76*a* with bracket 95 to retract each finger 28*a* to its retracted phantom-line position, illustrated in FIG. 16, whereby the paper can be removed by the purchaser. It should be noted in FIG. 16 that when finger 28*a* is in its extended position within the fold of a newspaper, a pin pivotally connecting link 93 to lever 91 is disposed in an overcenter position relative to pivot pin 92. Thus, the finger will remain in the fold upon initial opening of the door, under the biasing force of torsion spring 88, until collar 76*a* engages bracket 95 to release overcenter linkage 90. Upon such release, the spring will aid in retracting the finger to its solid-line inoperative position. As suggested above, upon closing of the door, the overcenter linkage is "recocked" when collar 74*a* engages bracket 95 to extend the finger into the fold of the next following newspaper.

It should be understood by those skilled in the arts relating hereto that the teachings of this invention could be easily followed to convert the FIGS. 1–12 vending machine embodiment to dispense individual newspapers from a top of stack S, as suggested in FIG. 14, rather than from the bottom thereof. In addition, vending machine 20 could be converted to utilize the door responsive newspaper dispensing mechanism in lieu of reciprocal dispensing assembly 27 or 27'. Otherwise stated, a particular vending machine could be of the bottom dispensing type, illustrated in FIGS. 1–12, utilizing either the reciprocal dispensing assembly or the door responsive dispensing mechanism described above. Likewise, vending machine 20*a* could be of the bottom dispensing type employing either the reciprocal dispensing assembly or the door responsive dispensing mechanism.

We claim:

1. A dispensing apparatus for dispensing newspapers, magazines, or like folded articles comprising first means for retaining a stack of articles in a stored position, said articles each being folded-over onto itself to define a fold, and second means for individually moving each article from said stack of articles and in a first direction including movable finger means for engaging within said fold and for pulling said article to a dispensing position from said stored position and actuating means, including a bellcrank, for reciprocating said finger means in a second direction at least approximately perpendicular relative to said first direction between a retracted position outside of said fold and an extended position within said fold, said finger means including a pair of laterally spaced and aligned fingers each positioned to be inserted into a respective lateral end of the fold of said article and wherein a said bellcrank is connected to each of said fingers.

2. The dispensing apparatus of claim 1 wherein said second means moves said article from the bottom of said stack.

3. The dispensing apparatus of claim 1 wherein said second means moves said article from the top of said stack.

4. The dispensing apparatus of claim 1 further comprising a stationary frame and wherein said second means further comprises a dispensing assembly reciprocally mounted on said frame for movement in the direction of a longitudinal axis thereof and wherein said finger means is mounted on said dispening assembly.

5. The dispensing apparatus of claim 4 wherein said finger means is mounted on said dispensing assembly for reciprocal movement transversely relative to said axis from an extended position within said fold when said article is moved from its stored position towards its dispensing position to a retracted position outside of said fold when said article is at its dispensing position.

6. The dispensing apparatus of claim 5 wherein said actuating means automatically moves said finger means between its extended and retracted positions in response to reciprocation of said dispensing assembly from said stored position rearwardly on said frame to said dispensing position forwardly on said frame.

7. The dispensing apparatus of claim 6 further comprising a pair of laterally spaced rails each extending in the direction of said axis and being parallel therewith and wherein said dispensing assembly includes a pair of laterally spaced brackets, each mounted for reciprocal movement on a respective one of said rails, and said finger means includes a pair of laterally spaced and aligned fingers, each mounted on a respective one of said brackets.

8. The dispensing apparatus of claim 7 wherein a said bellcrank is pivotally mounted on each of said brackets and is connected to a respective one of said fingers.

9. The dispensing apparatus of claim 8 wherein said bellcrank comprises a first arm pivotally connected to said one finger and a second arm and wherein said actuating means further comprises first and second stop means spaced longitudinally in the direction of said axis and having said second arm positioned therebetween for pivoting said bellcrank to move said one finger to its extended position in response to retraction of said dispensing assembly to said stored position and simultaneous engagement of said second arm with said first stop means and to move said one finger to its retracted position in response to movement of said dispensing assembly to said dispensing position and simultaneous engagement of said second arm with said second stop means.

10. The dispensing apparatus of claim 4 further comprising actuating means for selectively moving said dispensing assembly from said stored position to said dispensing position, said actuating means including a handle, a rock shaft rotatably mounted on said frame and secured to said handle, and a telescopic link interconnected between said rock shaft and said dispensing assembly.

11. The dispensing apparatus of claim 1 further comprising first and second members defining a dispensing opening therebetween for individually dispensing said article therethrough, said finger means being disposed at least substantially centrally of said opening, and adjustment means for simultaneously moving said first and second members towards or away from each other at least substantially equal amounts to selectively narrow or widen said dispensing opening to accommodate articles having varied thicknesses and to maintain said central disposition of said finger means relative to said opening.

12. The dispensing apparatus of claim 11 further comprising a stationary frame and wherein said first and second members are each pivotally mounted on said frame.

13. The dispensing apparatus of claim 12 wherein said adjustment means includes a bellcrank pivotally mounted on said frame and first and second links pivotally interconnected between said first and second members and said bellcrank, respectively.

14. The dispensing apparatus of claim 13 wherein said actuating means further comprises a rock shaft secured to said bellcrank and aligned with a point whereat said bellcrank is pivotally mounted on said frame and means for selectively rotating said rock shaft to pivot said bellcrank.

15. The dispensing apparatus of claim 11 wherein said first member comprises a table having said stack of articles thereon and said second member comprises a gate disposed transversely relative to said table at a forward end thereof, said dispensing opening being defined between a lower edge of said gate and an upper side of the forward end of said table.

16. The dispensing apparatus of claim 11 wherein said first member overlies said stack of articles and said second member comprises a gate disposed transversely relative to said first member at a forward end thereof, said dispensing opening being defined between an upper edge of said gate and a lower side of the forward end of said first member.

17. The dispensing apparatus of claim 1 further comprising a door pivotally mounted on said dispensing apparatus and wherein said second means is responsive to opening of said door to pull said article to said dispensing position from said stored position by said finger means.

18. The dispensing apparatus of claim 17 wherein said second means comprises a plate pivotally mounted interiorly on said door and wherein said finger means is movably mounted on said plate.

19. The dispensing apparatus of claim 18 wherein said bellcrank is pivotally mounted on said plate, said bellcrank having first and second arms, and wherein said finger means is secured to the first arm of said bellcrank.

20. The dispensing apparatus of claim 19 further comprising torsion spring means for engaging the first arm of said bellcrank to urge said finger means to a retracted position.

21. The dispensing apparatus of claim 20 further comprising overcenter linkage means interconnected between said plate and the second arm of said bellcrank for maintaining said finger means in an extended position against the biasing force of said torsion spring means.

22. The dispensing apparatus of claim 21 further including a rod pivotally connected to said linkage means, a stationary bracket having said rod reciprocally mounted therein, and first and second stop means mounted in longitudinally spaced relationship on said rod for alternately engaging said bracket to move said finger means to its retracted and extended positions, respectively.

23. The dispensing apparatus of claim 3 wherein said first means comprises a table having said stack of articles retained thereon, spring means for supporting and biasing said table upwardly, and a member overlying said stack of articles.

24. The dispensing apparatus of claim 23 wherein a forward portion of said table is pivotally mounted thereon and spring means for biasing said forward portion upward against said stack of articles to compensate for the varied thickness of the folds of said articles.

25. In a dispensing apparatus having first and second members defining a dispensing opening therebetween for individually dispensing a newspaper, magazine, or like folded article from a stack of folded articles, the improvement comprising adjustment means for simultaneously moving said first and second members towards or away from each other to selectively narrow or widen said dispensing opening to accommodate articles having varied thicknesses and finger means for engaging within the fold of said article and for moving said article to a dispensing position, said finger means being disposed at least substantially centrally of said dispensing opening throughout its narrowed and widened range of adjustment, said first member comprising a table having a stack of folded articles thereon and said second member comprising a gate disposed transversely relative to said table at a forward end thereof, said dispensing opening being defined between a lower edge of said gate and an upper side of the forward end of said table.

26. The dispensing apparatus of claim 25 further comprising a stationary frame and wheren said first and second members are each pivotally mounted on said frame.

27. The dispensing apparatus of claim 26 wherein said adjustment means includes a bellcrank pivotally mounted on said frame and first and second links pivotally interconnected between said first and second members and said bellcrank, respectively.

28. The dispensing apparatus of claim 27 further comprising a rock shaft secured to said bellcrank and aligned with a point whereat said bellcrank is pivotally mounted on said frame and means for selectively rotating said rock shaft to pivot said bellcrank.

29. The dispensing apparatus of claim 25 wherein said first member overlies said stack of articles and said second member comprises a gate disposed transversely relative to said first member at a forward end thereof, said dispensing opening being defined between an upper edge of said gate and a lower side of the forward end of said first member.

30. The dispensing apparatus of claim 25 further comprising means for individually moving each article from said stack of articles, including movable finger means continuously disposed at least substantially centrally of said dispensing opening for engaging within a fold of said article to pull said article through said dispensing opening.

31. In a dispensing apparatus having first and second members defining a dispensing opening therebetween for individually dispensing a newspaper, magazine, or like article from a stack of articles, the improvement comprising adjustment means for simultaneously moving said first and second members towards or away from each other to selectively narrow or widen said dispensing opening to accommodate articles having varied thicknesses, said first member comprising a table having a stack of folded articles thereon and said second member comprising a gate disposed transversely relative to said table at a forward end thereof, said dispensing opening being defined between a lower edge of said gate and an upper side of the forward end of said table.

* * * * *